US005517803A

United States Patent [19]

Stauber

[11] Patent Number: 5,517,803

[45] Date of Patent: May 21, 1996

[54] METHOD FOR PRODUCING TUBULAR PACKS FROM PRINTED PRODUCTS

[75] Inventor: Hans-Ulrich Stauber, Grüt, Switzerland

[73] Assignee: Ferag AG, Hinwil, Switzerland

[21] Appl. No.: 416,215

[22] Filed: Apr. 4, 1995

[51] Int. Cl.[6] ..... B65B 63/04

[52] U.S. Cl. ..... 53/399; 206/390; 53/118; 53/430

[58] Field of Search ..... 206/389, 390; 53/430, 118, 445, 399; 242/528

[56] References Cited

U.S. PATENT DOCUMENTS

| | | | |
|---|---|---|---|
| 3,395,789 | 8/1968 | O'Berry et al. | 206/389 |
| 4,326,632 | 4/1982 | Koob | 206/389 |
| 4,525,982 | 7/1985 | Meier | 53/430 |
| 4,606,173 | 8/1986 | Meier | 53/430 |
| 4,651,941 | 3/1987 | Muller | 53/118 |
| 4,688,368 | 8/1987 | Honegger | 53/399 |
| 4,811,548 | 3/1989 | Reist | 53/409 |
| 4,832,273 | 5/1989 | Honegger | 242/59 |
| 4,844,256 | 7/1989 | Honegger | 206/390 |
| 4,967,536 | 11/1990 | Reist | 53/118 |
| 4,984,411 | 1/1991 | Reist | 53/118 |
| 5,022,523 | 6/1991 | Honegger | 206/390 |
| 5,101,610 | 4/1992 | Honegger | 53/430 |
| 5,409,178 | 4/1995 | Stauber | 53/430 |

*Primary Examiner*—John Sipos
*Assistant Examiner*—Gene L. Kim
*Attorney, Agent, or Firm*—Walter C. Farley

[57] ABSTRACT

Tubular packs (P) are produced by winding a scale flow formation (1) of printed products on a mandrel, enveloping the roll with a protective and holding element (3) and removing the pack from the mandrel. In the interior of the pack (P) an additional product (2) is incorporated such that it can be removed from the finished pack regardless of the character of the pack without opening the protective and holding element (3) or without removing products of the scale flow formation (1). This is achieved by associating the additional product (2) to the scale flow formation to be wound in a position relative to the leading edge of the scale flow formation, which position is dependent on the stiffness and the length of the additional product.

4 Claims, 3 Drawing Sheets

METHOD FOR PRODUCING TUBULAR PACKS FROM PRINTED PRODUCTS

FIELD OF THE INVENTION

The invention is in the field of the further processing of printed products and relates to a method for producing tubular packs which contain wound, bendable, flat articles and in particular a wound scale flow formation of printed products enveloped with a protective and holding element.

BACKGROUND OF THE INVENTION

According to the prior art, flexible flat articles or objects, particularly printed products, are wound or rolled to form tubular packs for transportation purposes. During the same winding process, the packs are conventionally provided with a protective and holding element in the form of a paper sheet or a plastic sheet portion. Depending on the scale formation and on the winding process, the articles of the scale flow formation can or cannot be removable from the inside of the pack. For many applications, it is advantageous to roll the scale flow in such a way that the pack does not need to be "opened", in the true sense of the term, in order to permit removing individual articles. The protective and holding element is in this case not destroyed and the scale formation is not pushed together to form a stack. In addition to the advantage of the time and costs saved by the removal from the interior of the pack, the articles are also protected for a longer period against external influences such as wet and dirt by means of the still-intact protective and holding element.

Methods and apparatus for producing such packs are described, for example, in the publications EP-243 906 (U.S. Pat. No. 4,811,548) and U.S. Pat. No. 5,022,523, in which packs for removing individual articles from the center cavity are described, and in U.S. Pat. No. 5,101,610, in which a pack is described from which no individual articles can be removed. Furthermore in the publication EP-474 999 (U.S. application Ser. No. 08/069,019), a method and apparatus for the handling of such packs are described.

If, in addition to the articles, e.g. printed products, contained in the rolled pack in scale formation form, the pack is to contain additional information relating to the complete pack or the printed products contained therein, this can be simply printed on the protective and holding element or, if the latter is transparent, can be wrapped directly under that element.

Although this can be easily carried out during the production process, it suffers from the disadvantage that the carrier of the additional information can only be separated from the pack when the protective and holding element is removed, i.e. for a pack from which the articles are removed individually, only when the final printed product has been removed. If the carrier of the additional information is, e.g., a kiosk poster, this is not acceptable, because such a poster must naturally be displayed before the printed products are offered for sale, i.e. possibly at a moment when the pack is still intact.

SUMMARY OF THE INVENTION

An object of the invention is to extend the method for producing tubular packs of bendable and flat articles, particularly of printed products, enveloped by a protective and holding element such that each pack contains a complementary or additional product in such a way that the latter is safely held in the interior of the pack but nevertheless can be removed from there easily, regardless of whether the other articles (of the scale flow formation) contained in the pack can be removed in this way or not.

The inventive method is to be applicable also for an additional product largely different from the articles of the scale formation, not only regarding its format but also regarding its stiffness, "format" in this context meaning primarily the dimension of the articles in the direction of conveyance, the direction transverse to the conveying direction and thickness having little influence. This additional product may comprise one or more bendable flat objects, in particular printed products, which consist of one page only or of several pages and may be folded, stitched and so on. The introduction of the additional product is to be effected in such a way that the increase in time used for producing the pack due to the introduction of the additional product is kept to a minimum.

According to the inventive method, the additional product is associated with the scale flow formation being guided toward the mandrel to be wound onto the mandrel and it is then wound onto the mandrel together with the products in the scale flow formation. The additional product is positioned relative to the scale flow formation to be wound onto the mandrel in such a way that, firstly, at least one edge of the additional product is positioned directly on the winding mandrel; that, secondly, the additional product is kept safely in the pack after the mandrel is removed from the pack; and, thirdly, that the rolling time (i.e. the length of the item to be wound on the mandrel) is increased not at all or only minimally by the additional product.

BRIEF DESCRIPTION OF THE DRAWINGS

The inventive method is described in detail in connection with the following drawings, wherein.

DESCRIPTION OF THE PREFERRED EMBODIMENTS

Figure 1:
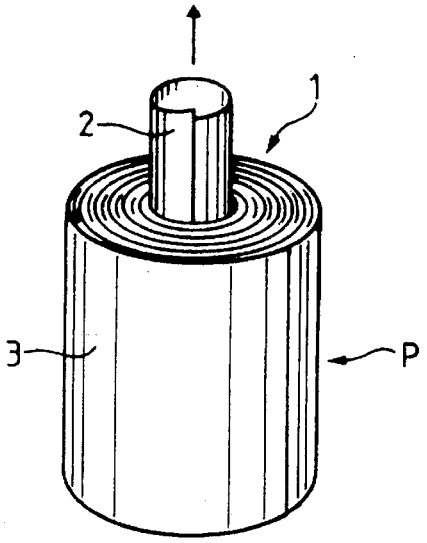
FIG. 1 is a perspective view of a tubular pack with an additional product formed according to the inventive method.

FIG. 1 shows a tubular pack P according to the invention comprising a wound or rolled scale flow formation 1, of which the imbricated articles can be clearly seen on the end faces of the pack, and an additional or complementary product 2, which is removed from the pack axially in accordance with the arrow. The pack is enveloped by a protective and holding element 3, which extends only over the circumferential surface of the pack or over its end faces also. The pack has an inner cavity and an inner surface around said cavity. In order to be able to remove the additional product effortlessly and easily without opening the pack or without removing any of the other articles, it is necessary for at least one edge of the additional product to be positioned on this inner surface of the pack.

Figure 2:
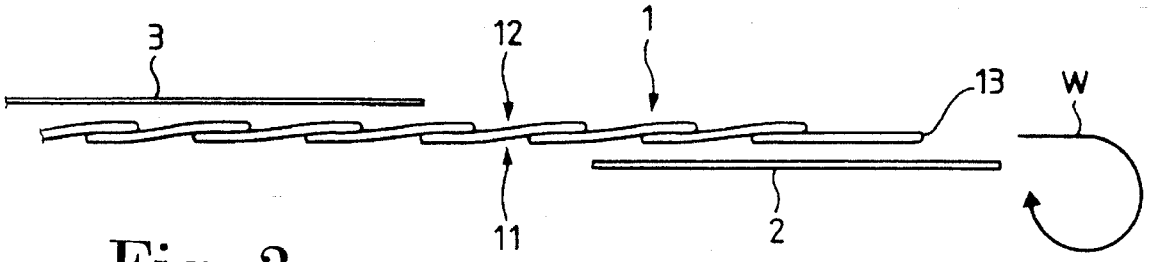
FIGS. 2 and 3 are schematic side elevations of two scale flow formations to be wound onto a mandrel to form tubular packs showing ways in which an additional product and a protective and holding element are associated with the scale flow.
Figure 3:
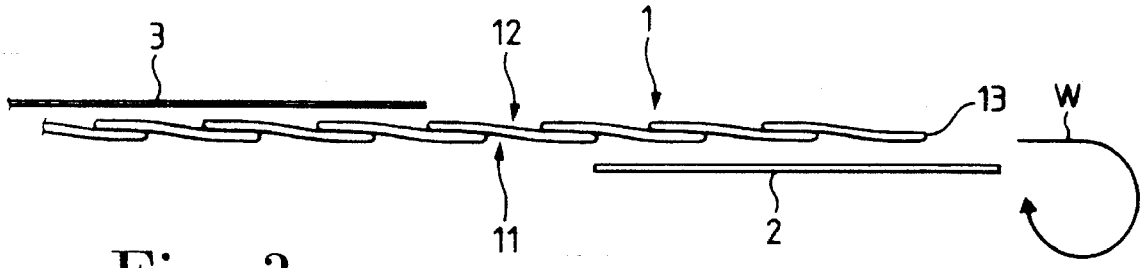

FIGS. 2 and 3 show two scale flow formations 1 to be wound on a conventional winding mandrel (not shown) in the direction of arrow W, i.e., such that the lower surface 11 of the scale flow formation is facing the mandrel. According to FIG. 2, the trailing edges of the printed products forming the scale flow formation are contained in this surface 11. This variant is to be chosen for producing a pack from which the scale flow products are to be removed individually. If the products need not be removed individually, the position in the scale flow formation relative to the winding direction may be reversed such that the scale flow surface 11 facing the mandrel in the winding process contains the leading edges of the articles, as illustrated in FIG. 3.

The diameter of the mandrel on which the scale flow formation is to be wound is selected such that the innermost of the wound products are bent to only such a degree that they are not permanently deformed and such that these innermost products by their elastic pressure towards the outer products and the protecting/holding element is strong enough to make the pack stable. This means that the mandrel diameter is determined by the quality of the articles which, as used herein, means the format and the stiffness of the scale flow articles. For stiffer articles the mandrel diameter needs to be greater than for less stiff articles.

The additional product 2 is associated with the scale formation 1 in the area of its leading edge 13 and on its side 11 facing towards the mandrel during the winding process, while the protective and holding element 3 is associated with the scale formation in the area of its trailing edge and on its other side 12, facing away from the mandrel surface during the rolling process.

For a short scale formation, FIGS. 2 and 3 may represent a real case. For a long scale formation the leading end of the latter will already be wound when the protective and holding element is associated with the pack.

Figure 5:
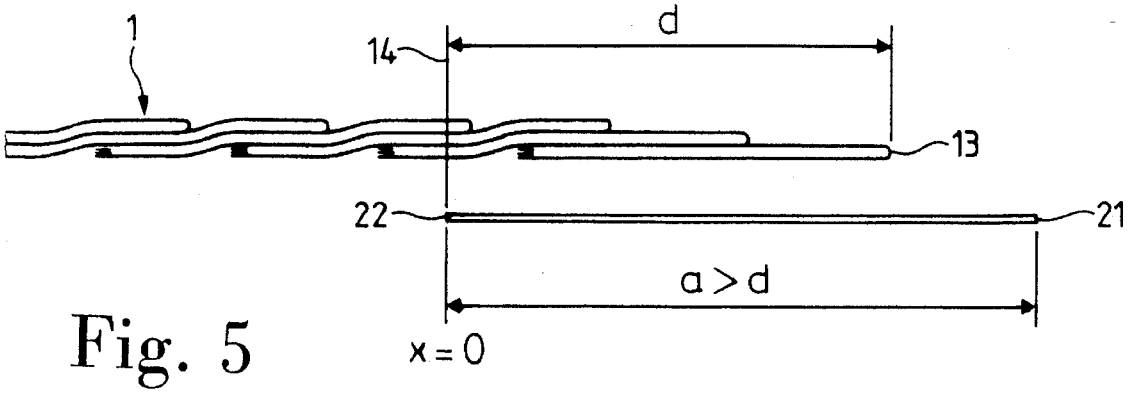
FIGS. 4, 5 and 6 are schematic side elevations of scale flows showing three ways for positioning an additional product relative to the scale flow formation applicable according to the format and the stiffness of the additional product.
Figure 4:
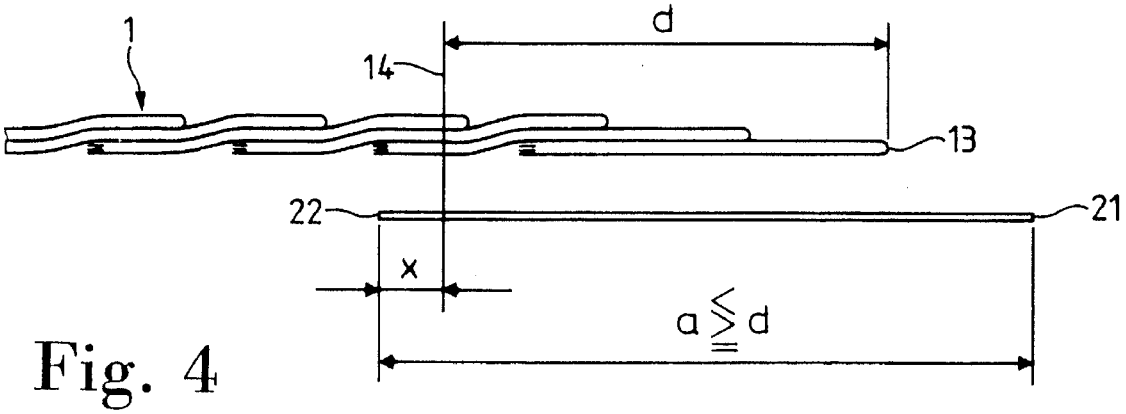
Figure 6:
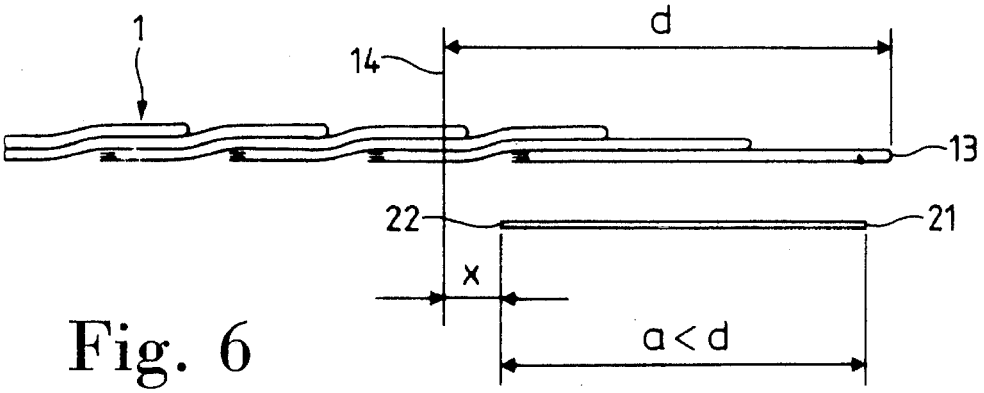

FIGS. 4 to 6 show three different ways for positioning the additional product 2 relative to the leading edge 13 of the scale flow formation 1 which are applicable according to the format and the stiffness of the additional product. As with FIGS. 2 and 3, the lower surface of the imbricated formation will be wound on the mandrel.

Generally speaking, the following conditions must be met:

In order to be able to remove the additional product 2 from the inside of the pack, at least its leading edge 21 must be accessible from the cavity of the finished pack, i.e., the leading edge must be positioned directly on the mandrel in the winding process. This means that the leading edge 21 of the additional product 2 is not to trail behind the leading edge 13 of the scale flow by more than the mandrel circumference d.

The additional product 2 must be coordinated with the scale formation 1 in such a way that it is kept safely in the cavity of the pack once the mandrel is removed. The additional product is kept in the cavity on the one hand by its own elasticity or springiness which presses it towards the articles of the scale flow formation wound around it and, on the other hand, its trailing edge 22 may be clamped between articles of the scale formation. The effect of the elasticity is dependent on the mandrel diameter and on the stiffness of the additional product, whereas the mandrel diameter is determined by the format and the stiffness of the scale flow products. The effect of the clamping between the products of the scale formation is dependent on the stiffness of the products of the scale formation and on the clamped length of the additional product. The clamping effect is therefore determined by the distance x by which the trailing edge 22 of the additional product trails behind line 14 which is spaced behind the leading edge 13 of the scale formation by a distance d, which is the mandrel circumference. For an additional product which has a stiffness much smaller than the stiffness of the scale formation products, x is to be chosen large, but for an additional product of about the same stiffness as the scale formation products x may be very small, zero or even negative, such that the trailing edge 22 of the additional product is positioned to the right of line 14.

If the increase of the time needed for rolling the scale formation, which increase is due to the additional product, is to be kept to a minimum, the additional product 2 is to be associated with the scale formation 1 in such a way that the leading edge 13 of the scale formation 1 trails behind the leading edge 21 of the additional product 2 as little as possible, or, if possible not at all.

The above three conditions for the relative position of the additional product 2 relative to the leading edge 13 of the scale flow formation 21 determine its relative position which is such that the trailing edge 22 of additional product 2 follows behind the leading edge 13 of the scale formation 1 by a distance d+x wherein d is the mandrel circumference and x has a value depending on the ratio of the stiffness of the additional product to the stiffness of the scale flow products and on the length of the additional product, which dependency renders x positive, negative or zero.

Although there is considerable latitude in the selection of the value x such that it is not definable by a specific mathematical formula, it can be said generally that it satisfies the following conditions where Sa is the stiffness of the additional product, Sp is the stiffness of a product in the scale flow and a is the length of the additional product:

$a>x>0$, for $Sa/Sp<1$ (FIG. 5);

$x=0$ for $Sa/Sp\geqq 1$ and $a\geqq d$ (FIG. 4);

$(a-d)<x\leqq 0$, for $Sa/Sp>1$ and $a<d$ (FIG. 6).

FIG. 4 shows the positioning of an additional product 2 which is stiffer than the articles of the scale flow formation and longer than the mandrel circumference (a>d). Because of its stiffness, it does not need to be clamped between articles of the scale flow formation and can be removed from the pack better if it is not clamped. For keeping its leading edge 22 as close as possible to the leading edge 13 of the scale flow formation (minimum length of the item to be wound), additional product 2 is positioned such that its trailing edge 22 trails behind the leading edge 13 of the scale flow formation by a distance which is equal to the mandrel circumference (x=zero).

FIG. 5 shows the positioning of an additional product 2 which is less stiff than the articles of the scale flow formation and whose length a is greater than the mandrel circumference d, but may be also smaller or equal to d. For being kept safely in the pack, it is advantageous to clamp its trailing edge 22 between articles of the scale flow formation, which is achieved by positioning its trailing edge 22 upstream of the leading edge 13 of the scale flow formation by a distance greater than the mandrel circumference by a clamping distance (positive x), whereby the clamping distance must not be greater than the product length a (leading edge 21 must be positioned to the right of line 14).

FIG. 6 shows the positioning of an additional product 2 which is stiffer than the articles of the scale flow formation and shorter than the mandrel circumference. The additional product does not need to be clamped between articles of the scale flow formation and does not need to be positioned exactly for minimizing the length of the item to be rolled. It is positioned such that the leading edge of the scale formation does not trail behind the leading edge of the additional product. x is zero or negative, but must not exceed the value of (d–a) (leading edges coinciding).

The width of the additional product transversely to the conveying and winding direction is advantageously the same or smaller than the width of the products of the scale formation. Only in this way does the additional product not project from the pack and is correspondingly adequately protected. If the additional product is narrower than the printed products of the scale formation, within the pack it can be moved centrally or against an end face or can be positioned engaging on the latter.

Figure 7:
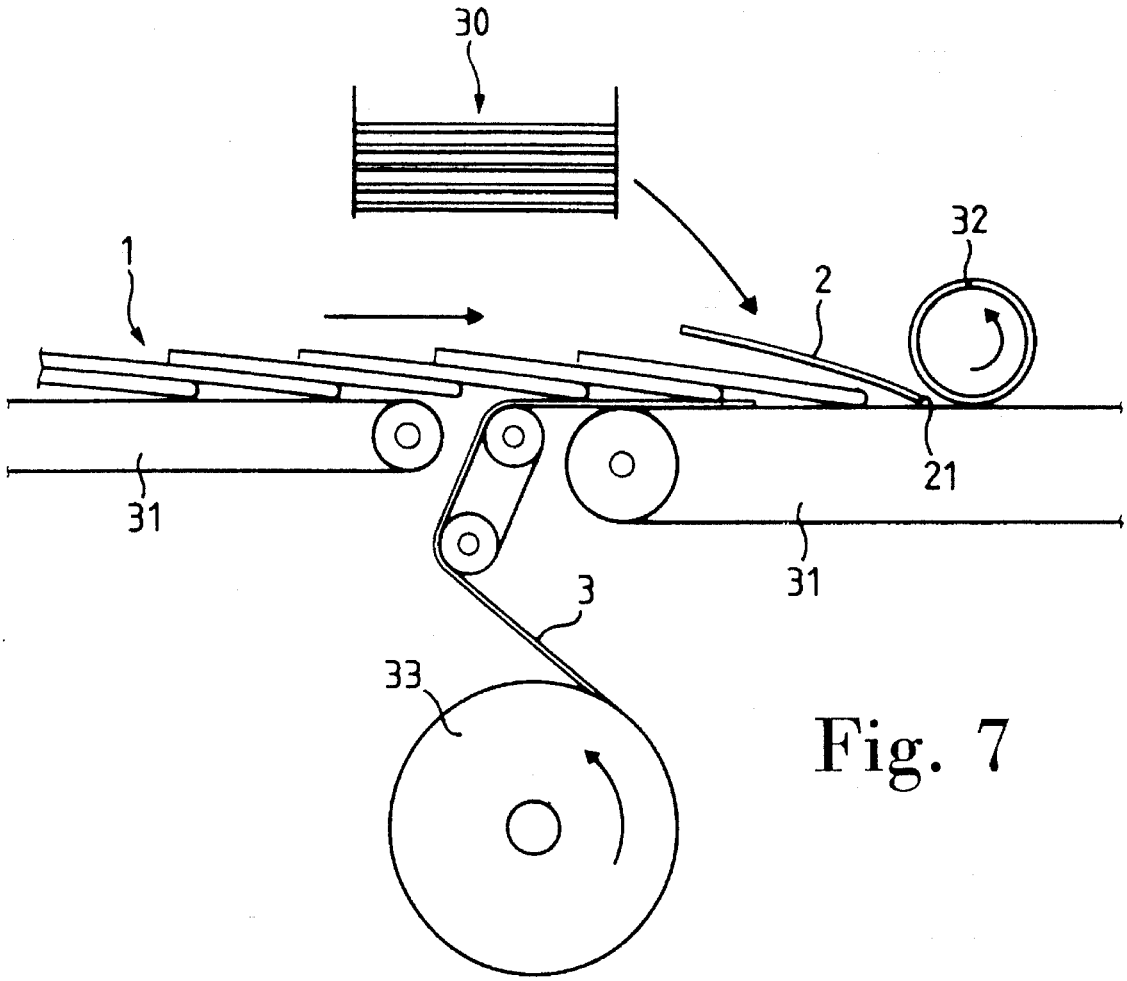
FIG. 7 is a schematic side elevation of a typical apparatus for carrying out the method of the present invention.

FIG. 7 shows in highly diagrammatic form an embodiment of an apparatus for performing the method according to the invention. The apparatus is in accordance with the aforementioned publications of the same applicant, which are here assumed as known, with the exception of a device 30 for the controlled supply of additional products 2. The apparatus has a conveying means 31 for supplying the scale formation and a winding device, whereof in FIG. 3 only the winding mandrel 32 is shown. It also can have a supply reel 33 for the material of the protective and holding elements and a suitable feed and cutting device (not shown). The device 30 for the controlled supply of the additional products 2 is advantageously positioned on the same side of the supplied scale formation 1 as the winding mandrel 32. It can be a controllable feeder or scale buffer or something of a similar nature. Such devices are available from the prior art and need not be described in detail here. The partial device 30 for the supply of the additional products 2 is so coordinated with the supply of the scale formation 1 that each scale formation intended for a pack has an additional product 2 associated with it with the desired position of the leading edge 21.

What is claimed is:

1. A method of producing a tubular pack of articles in a scale flow formation with an additional product in the center of the pack, comprising the steps of conveying a plurality of flat, bendable articles in a scale flow formation in a conveying direction toward a winding device with a mandrel having a central axis and an outer surface with a circumference determined by the quality of the articles of the scale flow formation and with a first face of the scale flow positioned so as to be toward the mandrel outer surface when the scale flow formation is wound on the mandrel and a second face positioned to be away from the mandrel when so wound, the formation having a leading edge and a trailing edge, providing adjacent the scale flow formation an additional flat and bendable product having a freely selectable length between a leading edge and a trailing edge and a freely selectable stiffness compared with the stiffness of the articles of the scale flow formation, positioning the additional product adjacent the first face of the formation, positioning the trailing edge of the additional product upstream of the leading edge of the scale flow formation by a distance (d+x) wherein d is the mandrel circumference and x is a value determined by the stiffness and the length of the additional product, providing an elongated protective and holding element having a leading edge and a trailing edge, positioning the protective and holding element with the leading edge thereof adjacent the second face of the scale flow formation and the trailing edge of the protective and holding element upstream of the trailing edge of the scale flow formation in the direction of conveyance, winding the scale flow formation together with the additional product and the protective and holding element onto the mandrel to form a tubular pack with the additional product at least partly against the mandrel outer surface and radially within the articles of the scale flow formation, and axially removing the tubular pack from the mandrel.

2. A method according to claim 1 wherein the additional product is less stiff than the articles of the scale flow formation and x is a positive value, smaller than the length of the additional product.

3. A method according to claim 1 wherein the additional product is stiffer and longer than the articles of the scale flow formation and x is equal to zero.

4. A method according to claim 1 wherein the additional product is stiffer and shorter than the mandrel circumference and x is negative and has an absolute value less than the difference between the length of the mandrel circumference and the length of the additional product.

* * * * *